US006837383B1

(12) United States Patent
McElhaney, Jr.

(10) Patent No.: US 6,837,383 B1
(45) Date of Patent: Jan. 4, 2005

(54) TOOL ORGANIZER MOUNTED TO A VEHICLE LIFT RACK

(76) Inventor: Wayne McElhaney, Jr., 30 Kish Ave., Washington, PA (US) 15301

( * ) Notice: Subject to any disclaimer, the term of this patent is extended or adjusted under 35 U.S.C. 154(b) by 0 days.

(21) Appl. No.: 10/649,201

(22) Filed: Aug. 28, 2003

Related U.S. Application Data

(63) Continuation-in-part of application No. 09/769,656, filed on Jan. 25, 2001, now abandoned.

(51) Int. Cl.[7] ..... A47F 7/00
(52) U.S. Cl. ..... 211/70.6; 211/86.01; 206/373
(58) Field of Search ..... 211/70.6, 86.01; 248/210; 182/129; 206/373; 312/244, 269

(56) References Cited

U.S. PATENT DOCUMENTS 4,211,455 A * 7/1980 Tedrow ..... 312/198
4,303,158 A * 12/1981 Perkins ..... 206/373
4,437,568 A * 3/1984 Hamblin ..... 206/223
4,703,850 A * 11/1987 Walker ..... 206/293
4,911,296 A * 3/1990 Hart, Jr. ..... 206/373
4,928,823 A * 5/1990 Campbell ..... 206/338
5,370,263 A * 12/1994 Brown ..... 220/751
5,547,080 A * 8/1996 Klimas ..... 206/373
5,725,096 A * 3/1998 Winnard ..... 206/350
5,727,649 A * 3/1998 Buckley ..... 182/129
5,749,437 A * 5/1998 Weller ..... 182/129
5,901,998 A * 5/1999 Gallo, Jr. ..... 294/143
5,913,380 A * 6/1999 Gugel et al. ..... 182/129
5,924,615 A * 7/1999 McGarrah ..... 224/404
5,951,129 A * 9/1999 Stein ..... 312/249.13
5,971,101 A * 10/1999 Taggart ..... 182/129
6,095,156 A * 8/2000 Smith, II ..... 132/286

* cited by examiner

*Primary Examiner*—Leslie A. Braun
*Assistant Examiner*—Khoa Tran
(74) *Attorney, Agent, or Firm*—John D. Gugliotta; Olen L. York, III

(57) ABSTRACT

A vehicle lift rack is provided as a mounted tool organizer for use with a conventional vehicle lift rack of a type having rack arms. A pair of support hooks, for grasping the rack arm in a manner that allows a containment volume to be supported through gravity impingement, without the necessity for permanent fasteners. The main containment volume is formed in a boxlike fashion and includes a hinged, lockable lid.

12 Claims, 2 Drawing Sheets

TOOL ORGANIZER MOUNTED TO A VEHICLE LIFT RACK

RELATED APPLICATIONS

This application is a Continuation-In-Part of U.S. application Ser. No. 09/769,656, filed on Jan. 25, 2001, now abandoned, which claimed the benefit of U.S. Provisional Application No. 60/174,986, filed on Jan. 7, 2000.

BACKGROUND OF THE INVENTION

1. Field of the Invention

The present invention relates generally to organizers and tool caddies and, more particularly, to a tool organizer specifically adapted to be supported by the lift arms of a conventional vehicle lift rack in an automotive garage.

2. Description of the Related Art

As anyone who performs a lot of mechanical work will attest, nothing beats having the proper tool for a job. The proper tool can save time, save money, produce a higher quality job, reduce damage to equipment, and provide for the increased safety of the worker. However, many times keeping track of such a quantity of tools can become overwhelming. While toolboxes and storage bins go a long way to helping this situation during storage of the tool, it does not help while the tool is being utilized. Here the tool can become easily misplaced, dropped, roll under something or become damaged. Nowhere is this more evident than when working under a motor vehicle. Such locations are often cramped and not very well illuminated. It becomes even more important to keep track of a tool under these conditions.

Consequently, a need exists for a means by which tools and/or parts can be held and organized while working under a motor vehicle held upon a vehicle lift rack in an automotive garage.

SUMMARY OF THE INVENTION

Therefore, it is an object of the invention to indicate a device of the type disclosed above which avoids the disadvantages inherent in the state of the art. In particular, the device is to be a tool box caddy with extending arms/hangers for suspending the caddy from the rails of a vehicle lift.

Briefly described according to one embodiment of the present invention, an apparatus is provided that attaches to a vehicle lift while working under motor vehicles. It has a tray area for holding such items as parts or tools. Along the front is an area with multiple holes of approximately three-quarters to one inch in diameter for holding items such as screwdrivers. Two "U" shaped arms protrude from the rear of the tray to attach the tray to the vehicle lift. The arms simply hook over the rack and the weight of the invention holds it into place. The arms are adjustable so that they may fit any size rack on a vehicle lift. Finally, located on the side of the device is a beverage holder that can be used to hold a cup of coffee or a can of soda.

Advantages of the present invention are numerous, and include the ability to keep all necessary items close at hand, saving time and also aiding in safety, as the user will not accidentally bang or bump into objects while groping for a tool or part. The use of the present invention allows automotive mechanics to keep all parts, tools, and other necessities handy while working under a motor vehicle on a vehicle lift.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within FIGS. 1 through 3*a*.

1. Detailed Description of the Figures

Figure 1:
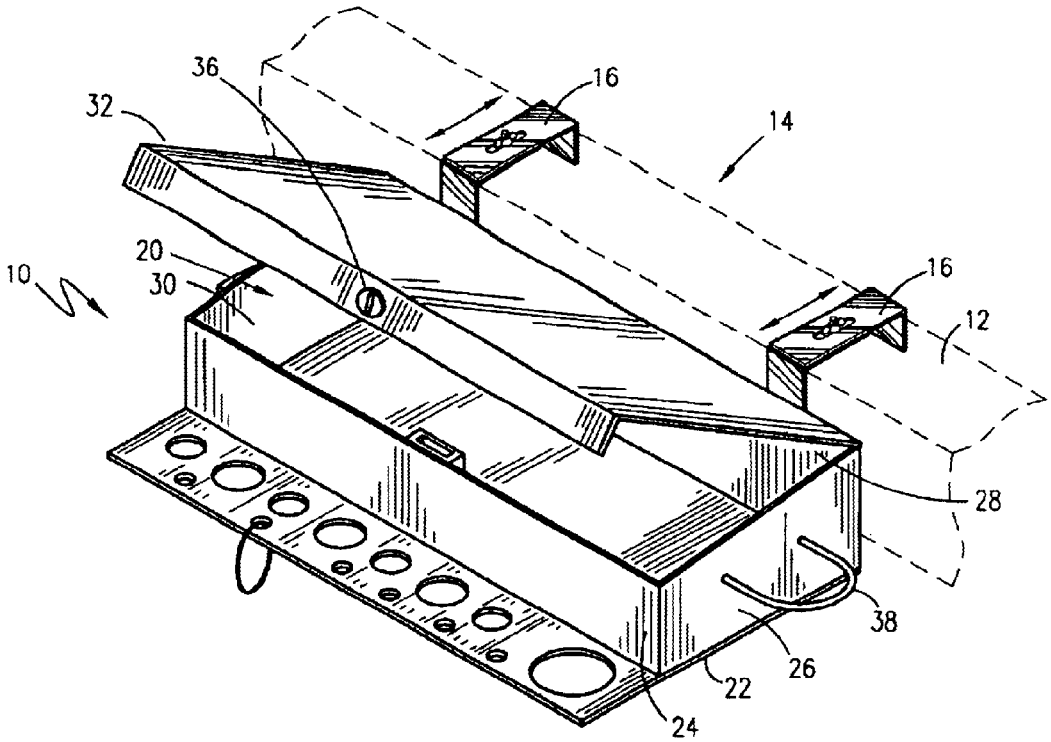
FIG. 1 is a perspective view of vehicle lift rack mounted tool organizer according to the preferred embodiment of the present invention.

Referring now to FIG. 1, a tool organizer mounted to a vehicle lift rack 10 (hereinafter "tool organizer") is shown in accordance with a preferred embodiment of the present invention. The tool organizer 10 is mounted for use to the support arms 12 of an otherwise conventional vehicle lift rack 14. The organizer 10 includes attachment means 16, shown herein a pair of L-shaped support hooks, for grasping the rack arm 12 in a manner that allows the organizer 10 to be supported through gravity impingement, without the necessity for permanent fasteners penetrating the hooks 16 and/or the support arms 12. In this manner, it is anticipated that the hooks will be adjustable in length, generally from between three (3) inches to five and one-half (5.5) inches in order to accommodate various widths of lift racks and the corresponding arms commercially available, although other variations in length of certainly envisioned. Extending cantilever outward from the support means 16 in a manner that hangs below the horizontal level of the support arm 12 is a main storage volume 20 formed by a base 22 and upstanding walls 24, 26, 28 and 30, respectively. A selectively articulating lid 32 (opening and closing) encloses the storage volume 20 via a hinge 34 and may include an optional key or combination lock 36 for securing the contents thereof. The storage volume 20 has an anticipated use for holding various tools, parts, fasteners, and other similar mechanical devices used during the analysis, maintenance, and repair of automobiles.

The upstanding walls 24, 26, 28 and 30 are more particularly identified as a front wall 24 opposite a rear wall 28, with a first sidewall 26 opposite a second sidewall 30, the first sidewall 26 and second sidewall 30 intermediately disposed between the front wall 24 and rear wall 28. In one embodiment of the present invention, the top portion of walls 24, 26, 28 and 30 are substantially identical in height, thereby forming a general orthogonal box-like configuration. In another embodiment of the present invention, the top portion of walls 26 and 30 are similarly inclined from the junction of front wall 24 and sidewalls 26 and 30 upward toward the junction of rear wall 28 and sidewalls 26 and 30. In this embodiment, rear wall 28 has a greater profile than front wall 24, thereby facilitating the inclination from front to rear. The desirability of this embodiment stems from the convenience and accessibility to the storage volume 20 with a lower profile front wall 24 as compared to the taller profile rear wall 28, thereby allowing a user to more easily view into the storage volume 20 and locate a specific tool, part or other device quickly and efficiently, while also reducing the opportunity for injury to the user or damage to the tool, part, other device or the tool organizer 10, respectively. In another embodiment of the present invention, at least one wall 24, 26, 28 and 30 includes magnetic properties for placement of metallic objects thereto for temporary storage or support. It is envisioned that the preferred wall of magnetization is either of the sidewalls 26 or 30, thereby providing the most convenient and unobtrusive location for temporary placement of a metallic object, including such metallic objects like screws, bolts, lugs, caps or other metallic objects found on or used with automobiles.

Figure 2:
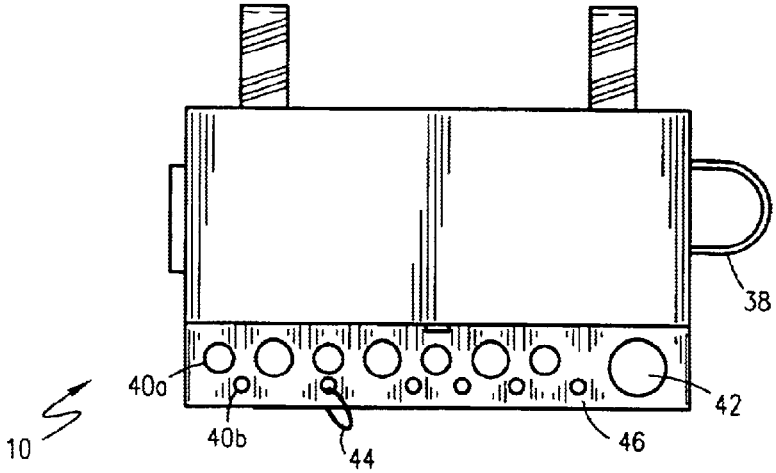
FIG. 2 is a top view thereof.
Figure 3A:
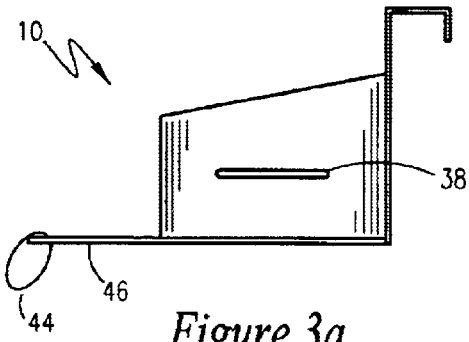
FIG. 3*a* is a side elevational view thereof.

Referring to FIGS. 2 and 3*a*, a variety of means for storing, supporting and holding tools, parts and other devices are anticipated as being elements of the best mode of the present invention. The means include support of pneumatic driving tools 38, support of mechanical hand tools (i.e., a screw driver) 40*a* and 40*b*, means for supporting cups 42, means for supporting towels or rags 44, and means for other similarly suitable tools, parts and other devices necessary for maintenance or repair of automobiles in an automotive garage. As indicated in the figures, means for support of a pneumatic driving tool 38 comprises a U-shaped ring affixed to an external portion of at least one sidewall 26 or 30, conveniently sized to accommodate pneumatic driving tools of the variety including torque wrenches or other similarly suitable devices used for removing or replacing lugs, screws, bolts or other threaded devices. Means for supporting mechanical hand tools comprise a plurality of intermediate apertures 40*a* and a plurality of small apertures 40*b* formed in a support plate 46 projected from the front of the tool organizer 10 and co-extensive with the base 22. The plurality of intermediate apertures 40*a* are sized to accommodate larger hand tools, including hammers, ratchets, hacksaws, and other similarly suitable hand tools. The plurality of small apertures 40*b* are sized to accommodate intermediate to smaller hand tools, including screw drivers, pliers, cutting snips or sheers, and other similarly suitable hand tools. Means for supporting cups 42 comprise at least one large aperture 42 also formed in the support plate 46, sized to accommodate STYROFOAM®, plastic or glass cups supporting a beverage of the user or for holding selected parts, such as screws, bolts, nuts, wiring, or other similar items used on or in an automobile. Means for supporting towels and/or rags 44 are also provided, comprising an annular ring 44 secured to the tool organizer 10 (shown in FIG. 2 as secured to tool organizer 10 via one of the small apertures 40*b*, although other points of securement are envisioned).

Figure 3B:
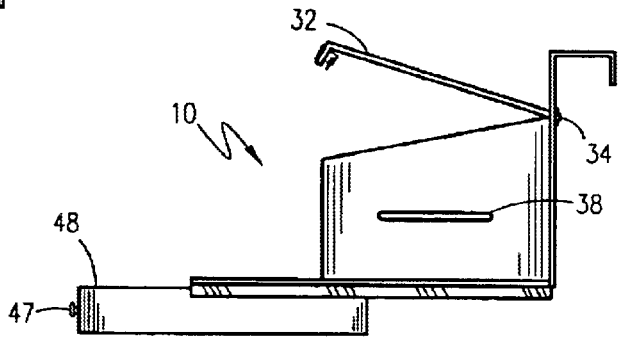
FIG. 3*b* is a side elevational view thereof shown with an optional storage drawer attached.

FIG. 3*b* shows an alternate embodiment of the present invention, in which a slidably retained storage drawer 48 is provided along the lower surface of the tool organizer 10, thereby allowing for additional storage. The face of the storage drawer 48 is co-extensive with the outward (anterior) margin of the support plate 46, and includes a handle 47 for easily grasping for selectively opening and closing the storage drawer 48.

The tool organizer 10 is envisioned as available in a variety of colors, particularly a yellow to gold coloring, which would include PANTONE® color identification system for "yellow" from "Process Yellow", PMS 100–102, PANTONE® Yellow, PMS 106–109, PMS 113–116, PMS 120–123, PMS 1205, 1215, 1225 and 1235, and PMS 127–130. The universal PANTONE®) color system for "gold" is also envisioned as suitable for visual indication and location of the tool organizer 10. In an automotive garage environment, a majority of the apparatuses and devices used are provided in dark colors, such as royal to navy blue and black, and mostly due to the aesthetic illusion of blue and black not being as easily dirtied in that environment. As such, the environment is inherently dark, and for this reason, the tool organizer 10 is provided in yellow to gold for allowing a user to easily view the tool organizer 10 and retrieve the necessary tools or items as required. Alternatively, illumination may be incorporated into the tool organizer 10 via an integral light or other similar means.

2. Operation of the Preferred Embodiment

In operation, the present invention is to aid in the analysis, maintenance, and repair of motor vehicles. Currently, such activities are generally performed by lifting the motor vehicle overhead by use of a hydraulic lift rack. To aid in this activity, the present invention can be simply slide mounted over the lift rack arms. From there, a service technician can store and support tools, fasteners, parts, and the like in a convenience fashion.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A tool organizer for mounting to and adapted for use with a vehicle lift rack having support arms, said tool organizer comprising:

four upstanding walls depending from a base and forming a storage volume for storing a plurality of tools and parts;

a selectively articulating lid enclosing said storage volume;

adjustable attachment means depending from said storage volume, said attachment means removably attachable to said support arms for supporting said tool organizer by gravity impingement;

a U-shaped ring affixed to an external portion of at least one of said walls, said ring for supporting a hand tool;

a support plate projected from a front of said tool organizer and co-extensive with said base;

a plurality of intermediate apertures formed in said support plate, said plurality of intermediate apertures adapted sized to accommodate intermediate and large hand tools;

a plurality of small apertures formed in said support plate, said plurality of small apertures adapted to accommodate small hand tools;

at least one large aperture formed in said support plate, said at least one large aperture adapted to accommodate a container.

2. The tool organizer of claim 1 further comprising a slidably retained storage drawer provided beneath said base and said support plate for additional storage area, said base and said support plate operating as an enclosure for said storage drawer.

3. The tool organizer of claim 2, wherein a face of said storage drawer is co-extensive with an anterior margin of said support plate, said storage drawer further comprising a handle for easily grasping for selectively opening and closing said storage drawer.

4. The tool organizer of claim 1, wherein said tool organizer rests cantilevered to said support arms, thereby positioning said storage volume below a horizontal level of said support arms.

5. The tool organizer of claim 1, wherein said four upstanding walls comprise a front wall opposite a rear wall, a first sidewall opposite a second sidewall, wherein said first sidewall and said second sidewall are intermediately disposed between said front wall and said rear wall.

6. The tool organizer of claim 5, wherein said rear wall comprises a greater vertical profile than said front wall for providing ease of access to said storage volume.

7. The tool organizer of claim 5, wherein said first sidewall and said second sidewall are inclined from said front wall to said rear wall for providing ease of access to said storage volume.

8. The tool organizer of claim 1, wherein said lid is affixed to said storage volume by an articulating hinge.

9. The tool organizer of claim 1, wherein said lid comprises a lock for securing contents of said storage volume from unauthorized removal and theft.

10. The tool organizer of claim 1, wherein said attachment means comprise at least one hook adjustable in length to accommodate variations in widths of said support arms.

11. The tool organizer of claim 1, wherein at least one of said upstanding walls comprises magnetic properties for attracting and supporting magnetic objects.

12. The tool organizer of claim 1, wherein said tool organizer comprises a color in a general class of yellow for providing visual indication of said tool organizer location.

* * * * *